US005651227A

United States Patent [19]

Anderson

[11] Patent Number: 5,651,227

[45] Date of Patent: Jul. 29, 1997

[54] BUILDING SIDING WITH POSITIVE INTERLOCK

[76] Inventor: Carl E. Anderson, 1011 Capouse Ave., Scranton, Pa. 18509

[21] Appl. No.: 500,334

[22] Filed: Jul. 10, 1995

[51] Int. Cl.[6] ..... E04D 1/34

[52] U.S. Cl. ..... 52/520; 52/519; 52/521; 52/547; 52/553

[58] Field of Search ..... 52/519, 520, 521, 52/547, 553

[56] References Cited

U.S. PATENT DOCUMENTS

| | | | |
|---|---|---|---|
| D. 352,362 | 11/1994 | Anderson . | |
| 3,504,467 | 4/1970 | Hatca et al. | 52/521 X |
| 3,520,099 | 7/1970 | Mattes | 52/521 X |
| 4,389,824 | 6/1983 | Anderson . | |
| 4,435,933 | 3/1984 | Krowl | 52/521 X |
| 4,435,938 | 3/1984 | Rutkowski et al. | 52/521 |
| 4,617,774 | 10/1986 | Pittman et al. | 52/553 X |
| 4,669,238 | 6/1987 | Kellis et al. | 52/521 X |
| 4,782,638 | 11/1988 | Hovind | 52/553 X |
| 4,864,787 | 9/1989 | Bukowski | 52/547 X |
| 4,947,609 | 8/1990 | Champagne | 52/547 X |
| 5,072,562 | 12/1991 | Crick et al. | 52/553 X |
| 5,475,963 | 12/1995 | Chelednik | 52/547 X |

*Primary Examiner*—Wynn E. Wood
*Attorney, Agent, or Firm*—Helfgott & Karas, P.C.

[57] ABSTRACT

Siding panels for covering the exterior wall of buildings mutually define a tongue and groove interfit which facilitates installation by placing the weight of an upper panel on an underlying lower panel instead of requiring an installer to hold the panel in place against gravity. Mounting nails are used in combination with the tongue and groove interfit to positively lock the tongue of one panel into the groove of the underlying panel. Nail placement is controlled by the relative placement of nail slots and hammer abutment surfaces formed on each panel. Because the panels must be pivoted in place and held in place by the overhanging siding nails, it is virtually impossible for the installer to make a mistake that results in an upper siding panel coming loose from the siding panel below.

16 Claims, 3 Drawing Sheets

BUILDING SIDING WITH POSITIVE INTERLOCK

BACKGROUND OF THE INVENTION

1. Field of the Invention

The present invention relates in general to building construction materials and particularly relates to stacked siding which is locked in place at its upper and lower edges.

2. Description of Prior Developments

Aluminum siding and plastic siding have been used for many years to provide a decorative and protective covering for the exterior walls of various structures, including industrial, commercial and residential buildings. Although prior siding configurations have, in general, performed satisfactorily, a recurring problem persists wherein strong winds, external impact or vandalism causes adjacent siding panels to disengage from one another and separate. Once separated, the panels not only create an unpleasant nonuniform appearance but also produce undesirable noise as they flap against one another in strong winds.

In order to prevent such disengagement, prior siding designs have relied upon various tongue and groove interconnections wherein the tongue or lip of one siding panel is resiliently deflected during insertion into a groove or channel on an adjacent panel. Although such spring biased frictional engagement presents an improvement over other prior designs, the panels still can become disengaged under high external loading if they are installed incorrectly.

Proper installation necessitates holding a panel in a totally engaged upward position before nailing. The end result of not properly holding a panel up during nailing is not discernible until it becomes totally engaged from a lower locking tab due to high wind, vandalism, etc. Holding a siding panel too tightly upward during nailing can result in subsequent rippling of the siding, especially when changes in the ambient temperature cause the panels to expand or contract. Holding a panel too loosely during installation also causes subsequent disengagement. Thus, a certain degree of skill is needed for proper installation.

Another drawback associated with prior siding designs is the difficulty experienced during installation of knowing when one siding panel is properly positioned and interengaged with another prior to nailing. That is, an installer is required to insert a loose siding panel into an adjacent panel which has been previously secured to a building by nailing and hope that the loose panel is properly positioned.

During such installation, the installer has to push the loose siding panel upwardly along the side of a building until the installer believes the siding panel is in full abutting engagement or "bottomed out" against and within the adjacent siding panel and then hold the panel in place while nailing it. This is quite a difficult task, especially when working with long lengths of siding which are not only cumbersome but also quite heavy, considering that the panel is held by only the thumb and second finger.

Clearly, this prior method of installation requires experience and skill to fully perfect and is therefore not particularly well adapted to practice by unskilled installers.

An aluminum siding stack-on panel is known which is wind vulnerable and, in fact, is known to come loose if an installer does not fully seat each panel. Sometimes an installer lifts the panels upward in an attempt to correct misalignments.

Another drawback associated with plastic siding is the difficulty of ensuring proper penetration of the mounting nails which fasten the siding to a building. Vinyl siding is typically allowed to shift a limited amount toward and away from its underlying wall by only partially driving and seating the mounting nails into the wall.

This technique leaves a portion of the nail shank extending above the wall surface and allows for some shifting and self-alignment of the siding against the wall, particularly in the case of warped wall surfaces. However, it is not uncommon for an unskilled installer to fully seat the nail against the siding panel thereby preventing the siding from shifting.

Accordingly, a need exists for a siding panel which is easy to install, which resists disengagement from an underlying panel during installation and which controls the extent of nail penetration so as to ensure a predetermined extent or length of nail projection above the nailing surface of the siding panel.

A further need exists for a siding panel which provides a positive locking engagement between adjacent siding panels, and which may be readily installed by relatively unskilled workers.

SUMMARY OF THE INVENTION

The present invention has been developed to fulfill the needs noted above and therefore has as an object the provision of a siding panel which is easy to install and which forms a positive locking interengagement with an adjacent panel.

Another object of the invention is to provide a plastic siding panel which controls and sets the amount of nail projection above the surface of the panel during its installation.

Another object of the invention is to provide a vinyl siding panel which is self-positioning and self-seating by its own weight.

Another object of the invention is to provide a siding panel which does not need to be held by an installer and supported against falling or slipping downward during installation.

Still another object of the invention is the provision of a seamless vinyl siding panel or a cut to length panel which uses mounting nails for both mounting a first panel to a wall and for providing a positive step for preventing disengagement of a second panel from the first panel.

Another object of the invention is to prevent an installer from pulling siding panels upward to correct misalignment that the installer created, thereby preventing panels from becoming disengaged.

These and other objects are met by the present invention which is directed to a siding panel, particularly a seamless plastic siding panel or panels cut to length, which includes an abutment surface or surfaces for engaging a hammer during installation of the panel. The abutment surfaces establish the final position of the heads of the mounting nails so as to establish a predetermined final location of the nail heads and a predetermined length of nail projecting from the wall being covered with the siding.

The location of the mounting slots or holes for receiving the mounting nails is aligned with respect to an adjacent locking channel or groove so as to position the mounting nails in an interference relationship with a mounting lip formed on another mating panel. This particular construction requires a unique pivoting motion for locking the mounting lip of one panel in the locking channel of another previously installed nailed down panel.

The locking channel is designed with an upwardly facing mounting groove for receiving and supporting the weight of an adjacent siding panel during installation. Once the mounting lip of an adjacent panel is pivoted and locked into the mounting groove, the weight of the adjacent panel is borne by the lip resting in the mounting groove or the full concavity of the upper panel resting on the full convexity of the panel below, thereby relieving the installer of the weight of the siding panel. This greatly facilitates installation and obviates subsequent repositioning of the mounting lip since it is positively locked in the locking channel under its own weight and cannot slip out insofar as the remainder of the panel is interlocked in the locking channel.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawings, like reference characters designate like parts.

DETAILED DESCRIPTION OF THE PREFERRED EMBODIMENTS

Figure 1:
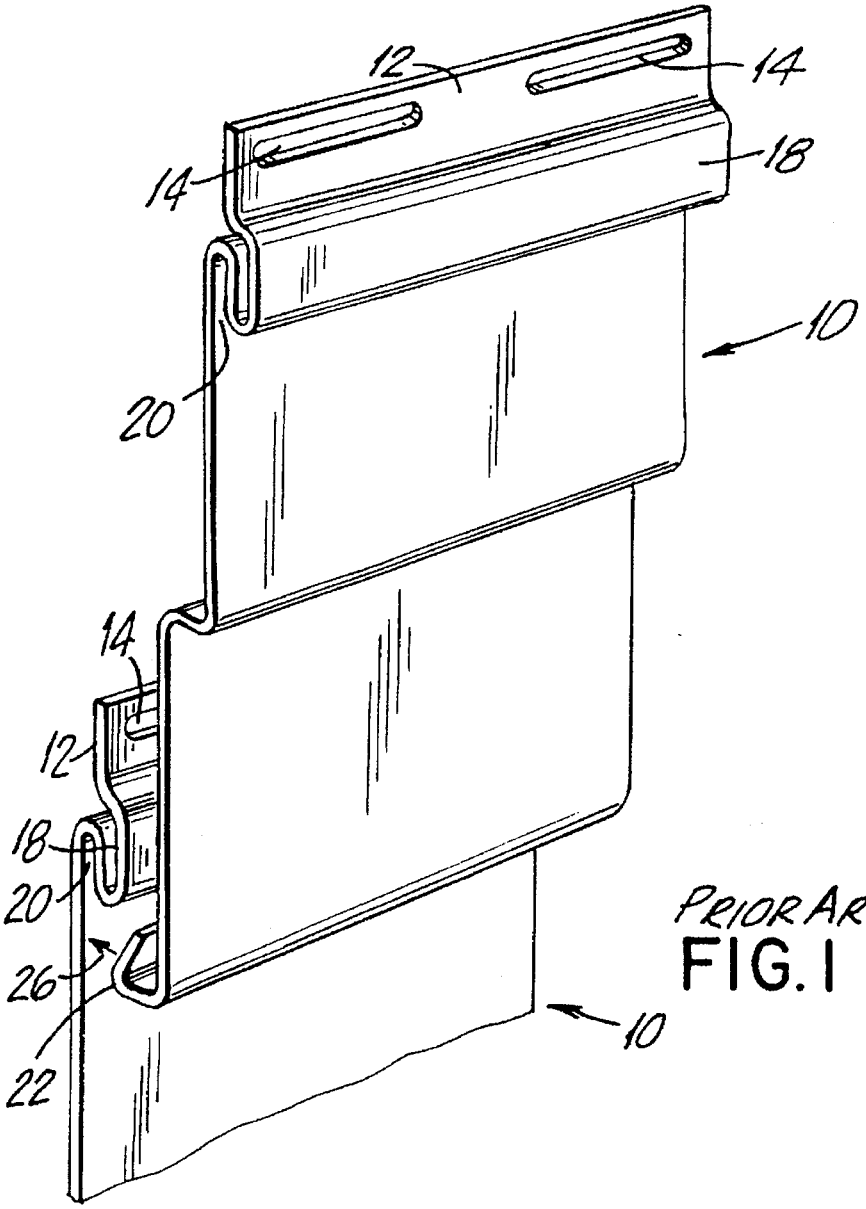
PRIOR ART FIG. 1
FIG. 1 is a perspective view of a pair of prior art siding panels, partly in section, showing the relative position of the panels prior to installation.
Figure 2:
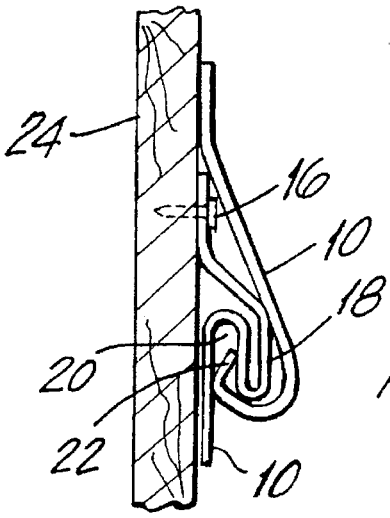
PRIOR ART FIG. 2
FIG. 2 is a side view of the prior art panels of FIG. 1 as installed on a wall.

A better appreciation of the present invention can be realized from a brief review of a siding panel construction arranged according to the prior art as shown in FIGS. 1 and 2. Prior vinyl siding constructions typically include a panel 10 having a top nailing or mounting strip 12 formed with slots 14 for receiving mounting nails 16.

Below the mounting strip 12 a somewhat N-shaped sinuous ridge 18 defines a downwardly facing groove 20 for receiving a mounting lip 22 formed on the lower edge of an adjacent siding panel 10.

During installation, a worker typically nails the lower siding panel to a wall 24 and lifts a second siding panel over and above the lower siding panel as shown in FIG. 1. This second siding panel is then pushed or slid upwardly so that the mounting lip 22 is deflected in the direction of arrow 26 (FIG. 1) within groove 20 and resiliently secured therein as shown in FIG. 2.

Although this procedure seems relatively simple, it can in fact be quite difficult when long lengths of siding panel are being installed. Such long panels twist and bend under their own weight and contort further in the presence of wind. This bending can unseat the mounting lip 22 from groove 20 and necessitate further alignment and reseating of lip 22 in groove 20.

In addition, during insertion of lip 22 in groove 20, an installer must support the full weight of the siding panel 10. After a short time, the installer can become fatigued. Moreover, if nail 16 is to be left partially projecting from wall 24 and panel 10 to allow for subsequent panel flexure, an installer must use personal judgment and skill when driving nail 16 into wall 24. The results are often erratic and substandard.

Figure 3:
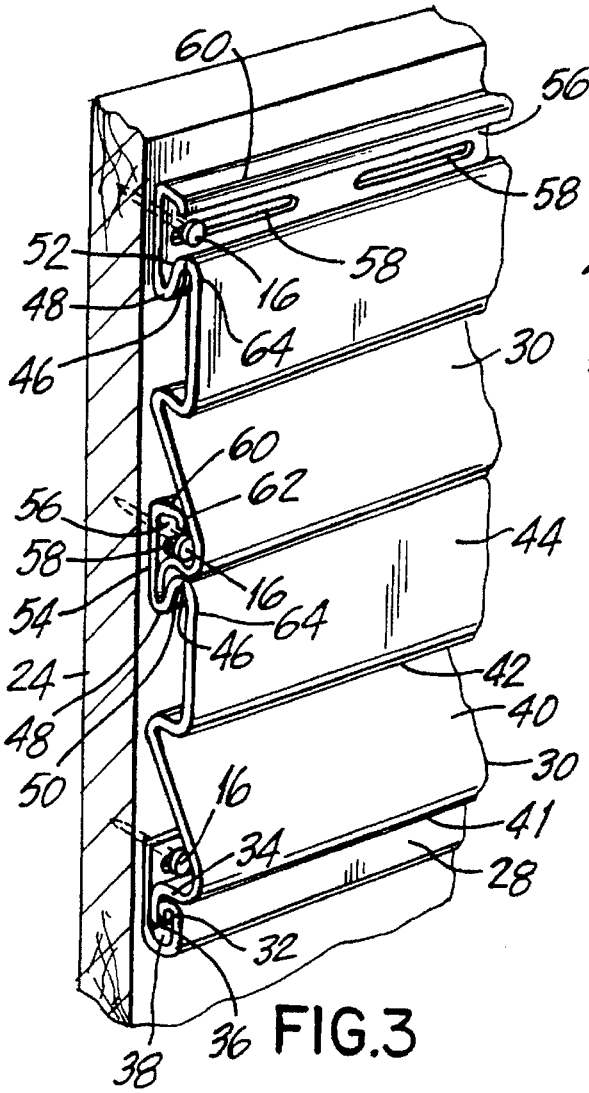
FIG. 3 is a perspective view of siding panels constructed in accordance with the invention.

In order to facilitate installation, reduce installer fatigue and provide uniform nail projection, the siding panel 30 of FIG. 3 has been developed in accordance with the present invention. The construction begins with a starter strip 28 of conventional design. Once starter strip 28 is nailed to wall 24, a first siding panel 30 is mounted to the starter strip and nailed to wall 24 as shown.

It should be noted that panel 30 need not be held in place by an installer during nailing since its weight is borne by the starter strip 28 and its vertical height is also maintained by the starter strip. More particularly, the upwardly projecting lip 32 of starter strip 28 engages and supports the underside of a somewhat horizontal mounting step 34 formed adjacent a lower vertical lip which forms locking flange 36 of panel 30.

The insertion of panel 30 into mounting channel 38 prevents locking flange 36 from becoming misaligned along wall 24 since the full weight of panel 30 serves to force and maintain lip 36 within channel 38 and to seat step 34 positively on lip 32.

Panel 30 extends upwardly from step 34 in an undulating profile which defines a first or lower tier 40 beginning at ridge 41. An intermediate sinuous step 42 extends outwardly from the top of lower tier 40 and curves upwardly into a second or upper tier 44. The top of tier 44 terminates in an upwardly facing convex outer portion defining a ridge 46 which transitions into a downwardly facing convex inner ridge 48 which shares a common intermediate wall 50 with ridge 46 so as to resemble the profile of a full sine wave.

The concave interior of ridge 48 defines a generally V-shaped or U-shaped interlock channel 52 having a flat sidewall 54 which extends upwardly to define a flat nailing strip 56. Nailing strip 56 is formed with perforations or slots 58 for receiving and positioning mounting nails 16 therein.

The top of nailing strip 56 extends horizontally outwardly over and above interlock channel 52 to provide an abutment ledge 60 which may terminate in a downturned lip 62. Ledge 60 overhangs the nailing slots 58. Abutment edge 60 and lip 62 limit the extent to which nail 16 may be driven into wall 24 and also sets the location of the nail head and the exposed length of the nail above nailing strip 56. That is, a hammer will hit the abutment edge, as well as the outer abutment wall 64 of convex ridge 46 and thereby be prevented from driving nail 16 any further into wall 24.

Figure 4:
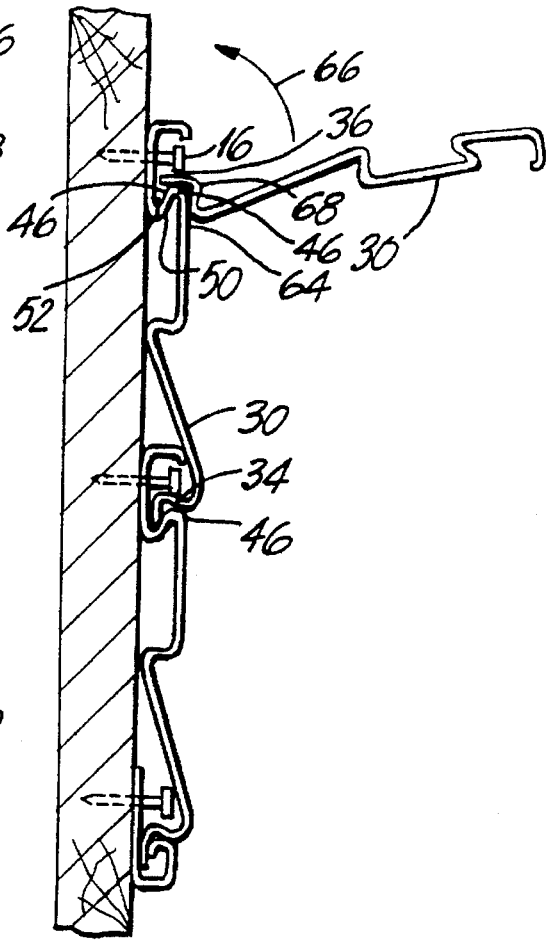
FIG. 4 is a side elevation view of siding panels constructed according to the invention and showing the mounting of a loose siding panel to a previously mounted siding panel.

The manner of installation of one siding panel 30 into locking engagement with another is shown in FIG. 4 wherein a loose siding panel 30 is shown at the top of the figure positioned horizontally with its lower flange 36 inserted between outer ridge 46 and nail 16. At this point of installation, ridge 46 serves as a fulcrum about which siding panel 30 is pivoted upwardly in the direction of arrow 66.

As the siding panel 30 is pivoted upwardly, its lower flange 36 and mounting step 34 can resiliently deflect within interlock channel 52 as the edge 68 of step 34 slides against the underside of mounting nail 16. Once edge 68 clears mounting nail 16, the lower flange 36 permanently pivots and slides into interlock channel 52 and is positively retained therein by mounting nail 16 and common wall 50.

Figure 6:
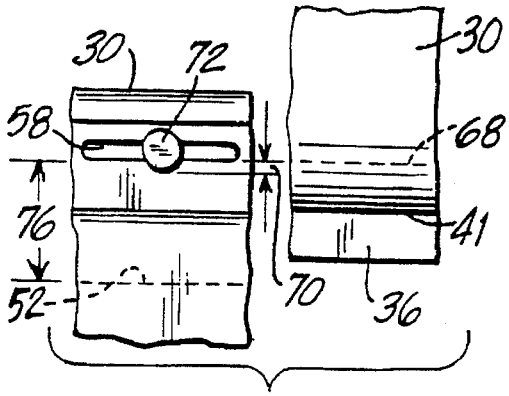
FIG. 6 is a front fragmental view of the relative spacing and location of the interlock formed between adjacent panels constructed according to the invention.
Figure 5:
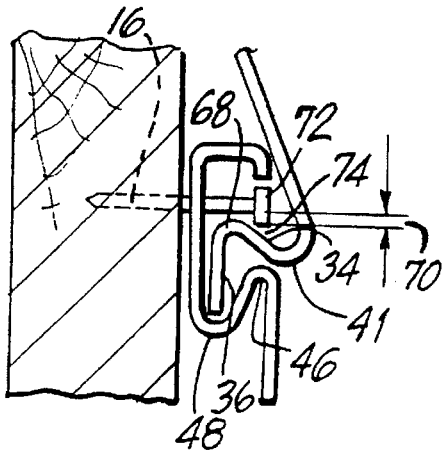
FIG. 5 is an enlarged fragmental view of the interlock formed between the siding panels of FIGS. 3 and 4.

One form of such positive retention is shown in detail in FIGS. 5 and 6 wherein the top of edge 68 of step 34 is shown nested a distance 70 beneath the head 72 of nail 16.

It is also possible to carry out the invention and form a positive interlock without the overlap 70 between flange 36 and nail 16 by simply dimensioning the length of flange 36 longer than the distance across opening 74 defined between nail head 72 and lip 46. This form of the invention is shown in FIG. 3 wherein the vertical distance 76 (depicted in FIG. 6) between the bottom on nail slot 58 and the bottom on interlock channel 52 is greater than the distance between nail head 72 and the top of edge 68.

Another way to define the interlock is to dimension the length of flange 36 greater than the length of the opening 74 and less than the length of dimension 76. In fact, as long as flange 36 interferes with both nail 16 and lip 46 in order to pass through opening 74, an interlock will be established in accordance with the invention. It is not always necessary that the bottom of flange 36 engage the bottom of interlock channel 52.

Another desirable relationship is to dimension the length of flange 36 greater than the depth of interlock channel 52, that is, greater than the vertical height between inner ridge 48 and edge 68 of step 34. This ensures that the weight of the upper panel is applied to the interlock channel 52 to help maintain flange 36 within the interlock channel.

Figure 7:
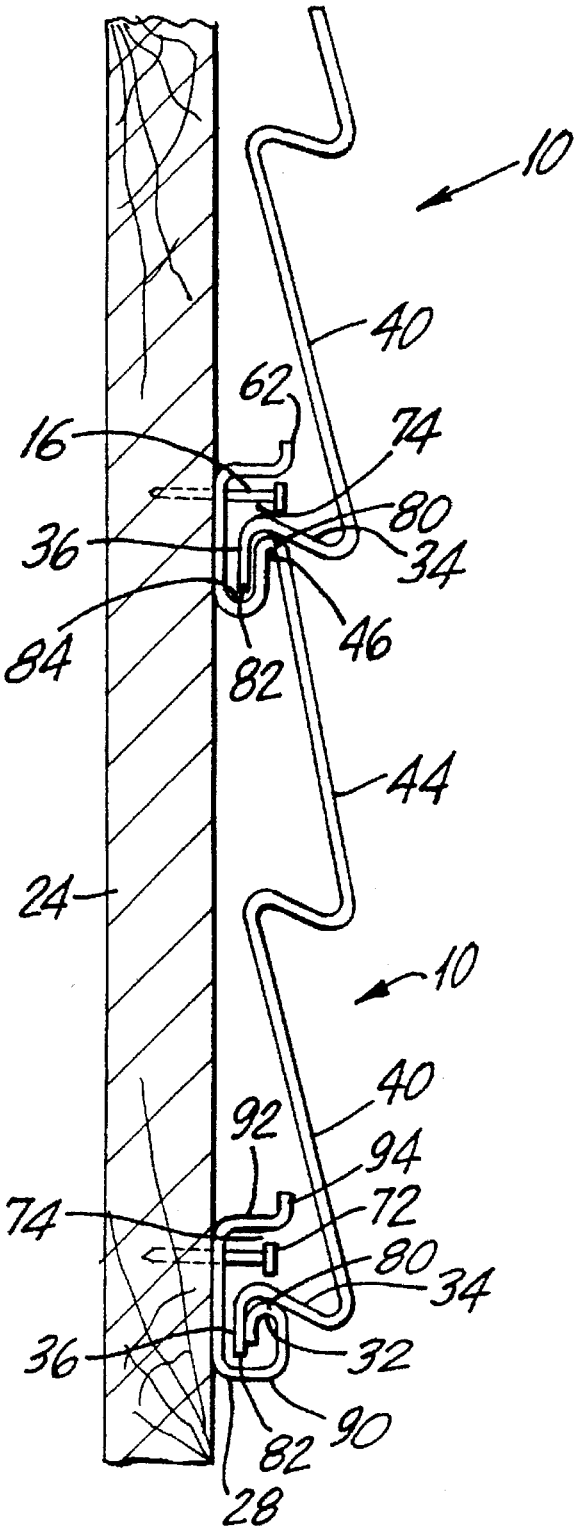
FIG. 7 is a side elevation view of an alternate embodiment of the invention.

As shown in FIG. 7, it is also possible to fully nest the convex ridge 46 of a lower panel 10 within a complimentary mating concave support channel 80 formed beneath mounting step 34 of an upper panel 10. This nesting of concave and convex surfaces between adjacent panels provides greater rigidity to the interconnection and interlock between the panels by effectively doubling the material section along the mating surfaces of ridge 46 and support channel 80.

In the embodiment of FIG. 7, the length of locking flange 36 is dimensioned less than the depth of interlock channel 52 so that the free end 82 of locking flange 36 is disposed above the bottom 84 of interlock channel 52. In this manner, the locking flange 36 will not interfere with the complete contact and engagement between ridge 46 and support channel 80. This complete nesting of adjacent panels provides a totally uniform look to the assembled panels.

Another modification of the invention shown in FIG. 7 is the use of an upturned or upwardly directed lip 62 for engaging a nail hammer as nail 16 is driven into wall 24. Lip 62 serves as noted previously to set the location of nail head 72 with respect to each interlocked panel 10,10 and with respect to opening 74 defined therebetween. By turning lip 62 upward, a savings in material can be realized and the overall rigidity of the panel can be enhanced.

Figure 8:
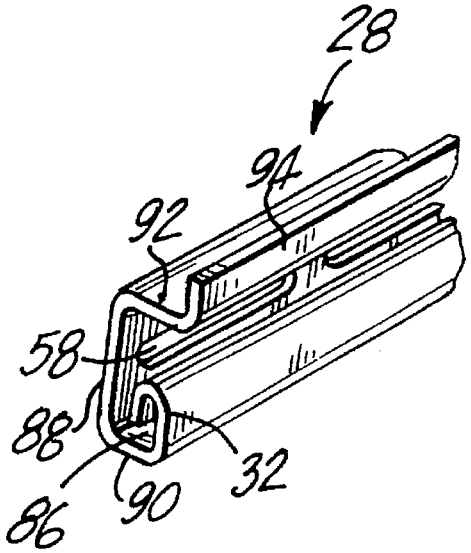
FIG. 8 is a fragmental perspective view of a starter strip constructed in accordance with the invention.

An improved starter strip 28 is depicted in FIGS. 7 and 8 wherein lip 32 is formed with an arcuate upwardly directed convex profile which matches the contour of the surface profile of support channel 80. Lip 32 is dimensioned so that the free end 82 of locking flange 36 is suspended above the bottom floor 86 of starter strip 28.

Starter strip 28, as shown in FIGS. 7 and 8 also includes a side wall 88 having nail slots for mounting strip 28 to wall 24, and a lower leg 90 and an upper leg 92 each extending outwardly from side wall 88. Upper leg 92 terminates in an upwardly directed hammer engaging abutment lip 94 which serves the same function as lip 62 noted previously. This version of starter strip 28 provides the same interlocking advantages as described with respect to the interlock between panels 10,10 of FIG. 7. That is, greater rigidity along the abutting surfaces of lip 32 and step 34, more uniformity in installed appearance, and positive positioning of nail head 72 within opening 74.

There has been disclosed heretofore the best embodiment of the invention presently contemplated. However, it is to be understood that various changes and modifications may be made thereto without departing from the spirit of the invention. For example, ridge or edge 68 of step 34 may be dimensioned so that it is disposed directly below nail head 72 rather than disposed below the shank of nail 16.

What is claimed is:

1. A siding panel, comprising:

a nailing strip extending along a top portion of said panel and having a nail slot formed therein; and an upwardly facing interlock channel extending along a bottom portion of said nailing strip for receiving and retaining therein a portion of another siding panel, said interlock channel including a sidewall extending into said nailing strip and an intermediate wall spaced outwardly from said sidewall.

2. The panel of claim 1, further comprising an upwardly facing outer ridge spaced outwardly from and below said nail slot, said outer ridge having one wall formed by said intermediate wall and further comprising an outer abutment wall for engaging said nail hammer.

3. The panel of claim 2, further comprising a locking flange extending along a bottom portion of said panel, said locking flange comprising a predetermined length and wherein said predetermined length is greater than the depth of said interlock channel.

4. The panel of claim 2, further comprising a locking flange extending along a bottom portion of said panel, said locking flange comprising a predetermined length and wherein said predetermined length is less than the depth of said interlock channel.

5. A siding panel, comprising:

a nailing strip extending along a top portion of said panel and having a nail slot formed therein;

an abutment ledge projecting outwardly from said nailing strip and overhanging said nail slot, said abutment ledge limiting nail penetration through said nail slot by abutment with a nail hammer:

a nail projecting outwardly from said nail slot, said nail comprising a nail head disposed beneath said abutment ledge; and an interlock channel disposed below said nail slot and extending upwardly and defining a convex ridge.

6. The panel of claim 5, wherein said nail head is disposed between said abutment ledge and said convex ridge.

7. A siding panel assembly nailed to a wall and comprising an upper siding panel secured to a lower siding panel, said upper siding panel comprising a locking flange and said lower siding panel comprising a nailing strip and an interlock channel extending upwardly to said nailing strip, said assembly further comprising a nail extending through said nailing strip into said wall and projecting outwardly from said nailing strip and over said locking flange to secure said locking flange within said interlock channel.

8. The assembly of claim 7, wherein said locking flange has a predetermined height and said interlock channel has a predetermined depth and wherein said height is greater than said depth.

9. The assembly of claim 7, wherein said locking flange has a predetermined height and said interlock channel has a predetermined depth and wherein said height is less than said depth.

10. The assembly of claim 7, further comprising an abutment ledge projecting outwardly from said nailing strip.

11. The assembly of claim 10, wherein said nail comprises a nail head, wherein said abutment ledge comprises a lip and wherein said nail head is disposed directly beneath said lip.

12. The assembly of claim 11, wherein said interlock channel comprises an outer wall extending upwardly to define a convex ridge.

13. The assembly of claim 11, wherein said nail head is disposed between said lip and said convex ridge.

14. A building panel starter strip, comprising:

a side wall having a nail slot formed therein;

an upper leg above said nail slot and a lower leg below said nail slot, each leg extending outwardly from said side wall and being generally parallel to each other;

an upwardly directed convex lip, an inverted u-shape, extending from said lower leg; and an abutment lip provided on said upper leg.

15. A method of installing a first loose siding panel onto a second nailed down siding panel, said first panel comprising a locking flange and said second panel comprising an open channel, and wherein said method comprises:

placing said locking flange of said first panel on said second panel so that at least a portion of the weight of said first panel is borne by said second panel; and pivoting said first panel against and around said second panel such that said locking flange is pivoted into said channel, and supporting substantially said entire first panel weight by said channel.

16. The method of claim 15, wherein said second panel comprises a nailing strip having a nail projecting outwardly therefrom over said channel, and said pivoting positions said locking flange into an interlocking engagement between said channel and said nail.

* * * * *